US010688018B2

(12) United States Patent
Stemple et al.

(10) Patent No.: US 10,688,018 B2
(45) Date of Patent: Jun. 23, 2020

(54) APPARATUS FOR CARDIOPULMONARY MASSAGING AND/OR RESUSCITATION

(71) Applicant: GS ELEKTROMEDIZINISCHE GERÄTE G. STEMPLE GMBH, Kaufering (DE)

(72) Inventors: Günter Stemple, Kaufering (DE); Christian Klimmer, Kaufering (DE); Michael Heller, Landsberg (DE)

(73) Assignee: GS Elektromedizinische Geräte G. Stemple GmbH, Kaufering (DE)

( * ) Notice: Subject to any disclaimer, the term of this patent is extended or adjusted under 35 U.S.C. 154(b) by 415 days.

(21) Appl. No.: 15/548,152

(22) PCT Filed: Jan. 14, 2016

(86) PCT No.: PCT/IB2016/050168
§ 371 (c)(1),
(2) Date: Aug. 2, 2017

(87) PCT Pub. No.: WO2016/125033
PCT Pub. Date: Aug. 11, 2016

(65) Prior Publication Data

US 2018/0042811 A1 Feb. 15, 2018

(30) Foreign Application Priority Data

Feb. 6, 2015 (DE) ..... 10 2015 101 706

(51) Int. Cl.
*A61H 31/00* (2006.01)

(52) U.S. Cl.
CPC ..... *A61H 31/006* (2013.01); *A61H 31/005* (2013.01); *A61H 2031/002* (2013.01);
(Continued)

(58) Field of Classification Search
CPC .... A61H 31/006; A61H 31/00; A61H 31/004; A61H 31/005; A61H 31/007;
(Continued)

(56) References Cited

U.S. PATENT DOCUMENTS 8,550,484 B1 * 10/2013 Draper ..... B62K 21/16 280/276
10,117,804 B2 * 11/2018 Nilsson ..... A61H 31/005
(Continued)

FOREIGN PATENT DOCUMENTS

DE 19704032 8/1998
DE 102011014304 9/2012
(Continued)

OTHER PUBLICATIONS

International Search Report dated Jun. 17, 2016.

*Primary Examiner* — Kendra D Carter
*Assistant Examiner* — Eric Theisen
(74) *Attorney, Agent, or Firm* — Fay Sharpe LLP

(57) ABSTRACT

The apparatus of the invention is used for cardiopulmonary massaging and/or resuscitation of a patient and includes a massaging device (15) which can be reversibly driven in an actuating direction (23) by a drive unit (18) and which has a pressure surface (20) that can be placed in a target contact zone (21) on the rib cage (12) of a patient (11). In order to easily and reliably prevent the pressure surface of the massaging device to deviate from a target pressure point (21), the plunger (19) can be secured to the rib cage (12) of the patient (11) in the target contact zone (21) and is mounted in such a way as to be freely movable in a plane running transversely to the actuating direction (23) at least during an unloaded state between two massaging strokes.

13 Claims, 6 Drawing Sheets

Figure 1:
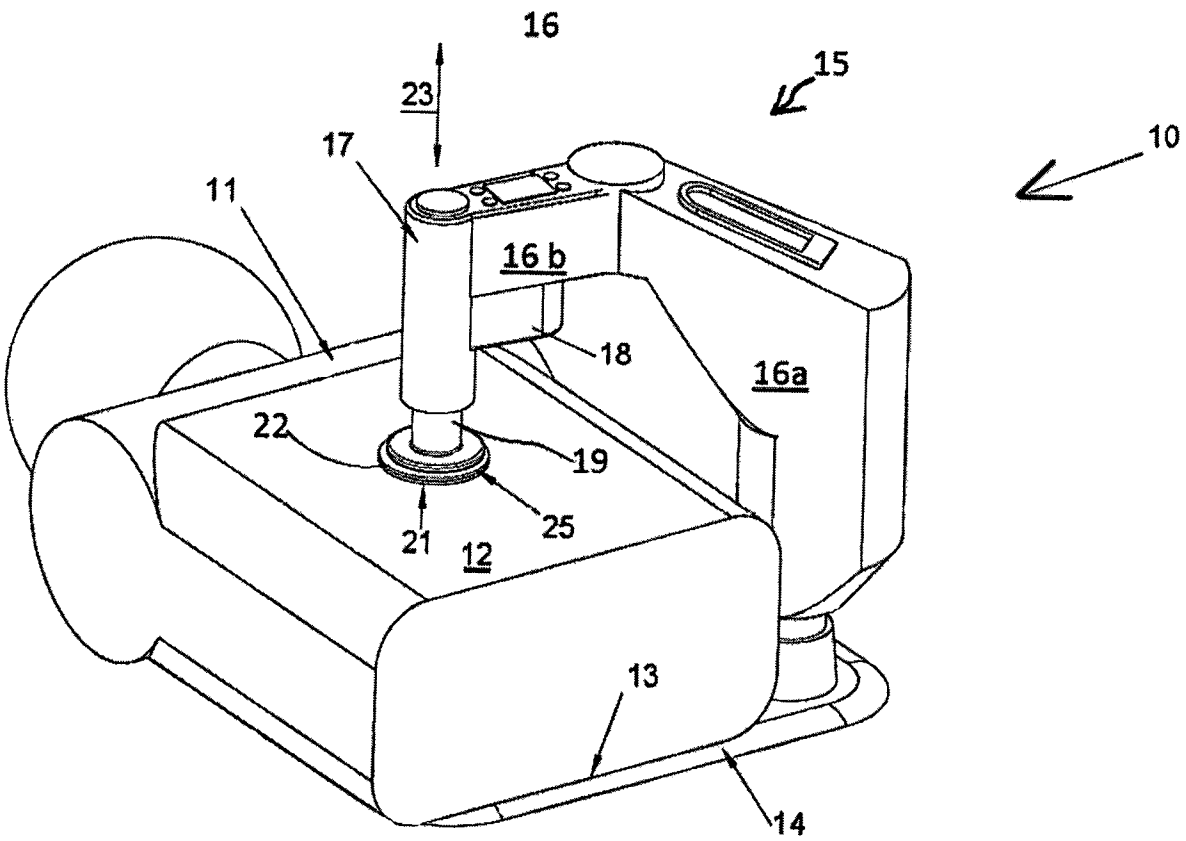

(52) U.S. Cl.
CPC ..... *A61H 2201/0173* (2013.01); *A61H 2201/0192* (2013.01); *A61H 2201/1207* (2013.01); *A61H 2201/1664* (2013.01); *A61H 2201/5007* (2013.01); *A61H 2201/5061* (2013.01); *A61H 2201/5064* (2013.01); *A61H 2201/5097* (2013.01); *A61H 2205/084* (2013.01)

(58) Field of Classification Search
CPC ..... A61H 31/008; A61H 31/02; A61H 2031/001; A61H 2031/003; A61H 2031/025; A61H 2201/0192; A61H 2201/0196; A61H 2031/002; A61H 2201/5058; A61H 2201/5061; A61H 2201/5064; A61H 2201/5007
See application file for complete search history.

(56) References Cited

U.S. PATENT DOCUMENTS 10,292,899 B2 * 5/2019 Nilsson ..... A61H 31/004
2005/0286968 A1 * 12/2005 Loebner ..... F16B 7/105 403/109.1
2012/0238922 A1 * 9/2012 Stemple ..... A61H 31/006 601/41
2013/0305863 A1 * 11/2013 Weslati ..... F16H 63/48 74/411.5
2014/0046228 A1 * 2/2014 Walker ..... A61H 31/006 601/41
2014/0066822 A1 * 3/2014 Freeman ..... A61H 31/00 601/41
2014/0171840 A1 * 6/2014 Aelen ..... A61H 31/00 601/41
2014/0265357 A1 * 9/2014 Romero ..... E05B 63/00 292/140
2015/0366751 A1 12/2015 Stemple

FOREIGN PATENT DOCUMENTS

DE 102013100943 7/2014
WO WO 97/18789 5/1997
WO WO-9718789 A1 * 5/1997 ..... A61H 31/02

* cited by examiner

APPARATUS FOR CARDIOPULMONARY MASSAGING AND/OR RESUSCITATION

The invention relates to an apparatus for cardiopulmonary massaging and/or resuscitation, with a massaging device having a plunger that is reversibly movable in an actuating direction, can be actuated by a drive and is placeable on the ribcage of a patient in a target contact zone. The invention relates further to a locking mechanism to block any movement between two translationally and/or rotationally interconnected transmission elements, more particularly to lock a hinge mechanism of the apparatus of the invention for cardiopulmonary massaging and/or resuscitation.

A respiratory or circulatory arrest is a very life-threatening condition for a patient. Only if an "emergency circulation" is successfully established and maintained within a very short time by means of cardiopulmonary resuscitation, is there any real chance that the patient will survive without permanent damage. Apart from respiration, a central part of cardiopulmonary resuscitation is the performance of a cardiac massage to produce a substitute circulation of blood, so vital organs, such as more particularly the brain, are supplied with oxygen. In this situation the classic cardiac massage is performed manually, i.e. for example by a paramedic, who compresses and releases the patient's thorax in the area of the sternum at rates of the order of 80-140 per minute and hereby causes blood to circulate through the patient's body and thus supply oxygen to the organs.

Manual compression of the thorax for resuscitation is very strenuous for the helper carrying it out and can be performed only for a limited time at the rate required. Because it frequently has to be continued also during transfer of the patient to hospital, mechanical devices for cardiopulmonary massage have been suggested, which complement the technical equipment of emergency vehicles, helicopters or the like and with the help of which the cardiac massage on patients can be carried out mechanically over practically any length of time, without the life-savers becoming tired. Instead, they can initiate additional life-saving measures, while the mechanical device performs compression of the thorax to maintain the emergency circulation. For this such a device has a massaging device with a plunger, which is driven by a drive at the desired rate, i.e. approx. 80-140 per minute reversingly, i.e. up and down. The plunger is placed by the doctor or paramedic on the patient's ribcage, in the place designated for the cardiac massage, and can then perform the massage.

For correct performance of the cardiac massage it is important to use the correct compression point and also to keep to it during the massage. The compression point is located directly above the breastbone (sternum), more precisely at the upper end of the lower third of the sternum. The sternum is the best area for performing the cardiac massage, because the heart—i.e. the organ that is to be compressed—is located directly beneath it. Moreover the breastbone is a solid bone, which is attached elastically to the ribs with cartilaginous joints and can thus move. Any deviation from the correct compression point can lead not only to a reduction in the effectiveness of the cardiac massage, but in some cases to serious injuries to the patient, of which rib fractures are for the most part the least problematic. If during cardiac massage the compression point shifts towards the epigastrium, serious injuries of the internal organs may result. Therefore, both when performing cardiopulmonary resuscitation manually and also when performing it with the use of a mechanical device, it is essential to keep to the correct compression point during the massage.

Known from DE 10 2013 100 943 A1 is a device of the generic type, where deviations of the actual position of the plunger in X-Y direction, i.e. the plane transversely to the actuating direction of the massaging device, from a target compression point on the patient's chest are detected through the provision of a position sensor device, with which changes in the position of the massaging device and/or of its plunger relative to the target contact zone on the patient's ribcage are detectable in a plane normal to the actuating direction of the massaging device. If the actual position of the plunger deviates from a target position and a preset limit is exceeded, the cardiac massage device is, for example, shut down automatically or an alarm signal is emitted, which indicates to the paramedics that readjustment is required. Alternatively, with the known device, it is also possible for an active position control of the massaging device transversely to its actuating direction to be achieved, to which end there is provided an actuator, repositioning the massaging device and its plunger in the plane normal to the actuating direction, with the help of which the determined actual position of the plunger is adjusted towards the target position.

The known device has proven itself to be very successful and reliable, though more particularly the realisation of the active repositioning of the plunger with an actuator provided for this purpose is relatively complicated and accordingly expensive. An object of the invention is therefore to create a device of the aforementioned type, with which adherence to the correct position of the plunger is achieved reliably with less complexity.

This object is achieved with the invention through the plunger being securable to the ribcage of the patient in the target contact zone and being mounted in such a way as to be freely movable in a plane running transversely to the actuating direction at least during an unloaded state between two massaging strokes.

By means of this solution a passive, quasi automatic positioning of the plunger in the X-Y plane is possible, for which, owing to the securing of the plunger in the target contact zone on the patient's ribcage, an actuator is no longer required. Instead, this securing ensures that the plunger always adopts the correct relative position to the patient's ribcage. Owing to the free mobility of the plunger transversely to the actuating direction, i.e. in the X-Y plane, the plunger is repositioned passively between two massaging strokes in each case, so it always balances out immediately any changes of position of the patient in the course of the prolonged massage and is always in the correct position, i.e. over the patient's breastbone, at the start of each and every subsequent massaging stroke owing to the securing that exists during the massage.

In advantageous further development of the invention it is provided that the plunger is lockable in its position relative to the ribcage of the patient in a loaded state during a massaging stroke in the plane transversely to the actuating direction. In this way it is possible to ensure that the position of the plunger in the plane transversely to the actuating direction (X-Y plane) does not change during the massaging stroke, i.e. the downward movement of the plunger that compresses the patient's ribcage. Therefore during this downward movement the plunger cannot inadvertently change its position to the side, for example owing to shear forces acting between the ribcage and the pressure surface of the plunger, which could be dangerous for the patient during the compression procedure.

The function according to the invention can be realised advantageously through the massaging device having at least one lockable and unlockable hinge mechanism, repositionable about an axis running parallel to the actuating device. It is particularly advantageous, if a locking mechanism, preferably actuated by a force sensor and/or path sensor, is provided to prevent transverse mobility of the plunger during a massaging stroke, more particularly to lock the at least one hinge mechanism.

The plunger is usefully secured or securable to a holding means attachable to the ribcage of the patient, wherein the holding means can be designed as a holding pad that can preferably be stuck onto the ribcage by means of an adhesive layer. For this it has proven to be very particularly advantageous, if the securing between the plunger and the holding means is accomplished by means of an effective hook-and-loop fastening between these two items. Here the holding pad is provided on its top side with one hook-and-loop fastening element, preferably the loop fabric, to which the other hook-and-loop fastening element fitted to the pressure surface of the plunger—in the preferably used arrangement the hook fastener—can be secured detachably. The doctor or paramedic first sticks the holding means, which preferably has a contact surface that is bigger than the pressure surface formed by the plunger, onto the patient's ribcage, over the breastbone, and can then line up the plunger precisely in the correct position above the holding pad and bring it into contact with the holding means by lowering it (preferably manually) until the hook-and-loop fastening closes and in this way securing of the plunger is established. Correction of the position is possible at any time, wherein, owing to the contact surface of the holding means being larger than the pressure surface of the plunger, it remains guaranteed that the plunger—for example, if the adhesive pad is applied imprecisely on the patient's chest—protrudes in an area to the side above the pad and is then not connected with the pad over its entire pressure surface.

According to the invention a support board placeable under the body of the patient and on which the massaging device is disposed may be provided. The massaging device can then be adjustable in respect of its height relative to the support board, so the device can be adapted easily to the particular patient.

It has also proven advantageous, if the plunger is disposed mounted such that it is freely rotatable on the massaging device, so the massaging device and its hinge mechanism can be repositioned at will, even if the plunger has already been secured to the patient's ribcage with its pressure surface.

In further development of the invention it can be provided that the plunger on the massaging device has approx. 10-15 mm of play in actuating direction. This will ensure that, during raising of the plunger in the release phase, i.e. in the respiration phase, the plunger does not exert any pulling force on the thorax. Thus, in the respiration phase, the thorax can fall and rise freely around this play.

Alternatively, however, it is also possible to achieve negative compression by using an arrangement without or with only a small amount of plunger play in actuating direction. In this way it is possible to bring about a firm coupling of the plunger with the thorax both during pushing and during pulling and to raise the ribcage actively with the drive of the massaging device, when the plunger is, for example, also secured to the thorax by means of a hook-and-loop fastening with pull-resistance. In this case the decompression is performed actively by the plunger.

To enable the plunger to be positioned optimally according to the shape of the patient's thorax, it is preferably attached to the massaging device by means of a ball joint.

Figure 2:
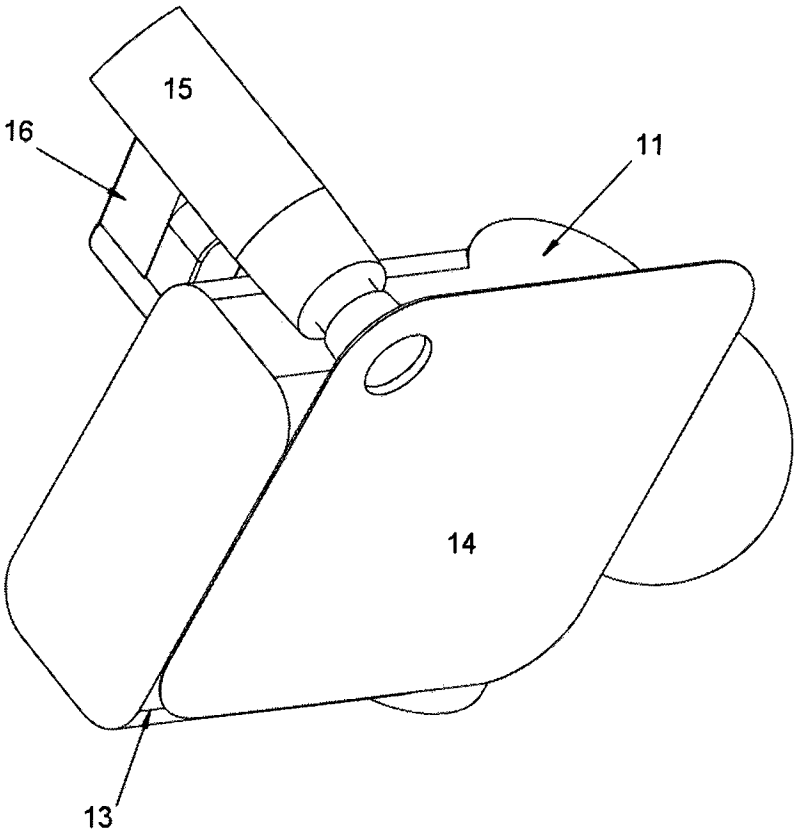
Figure 3:
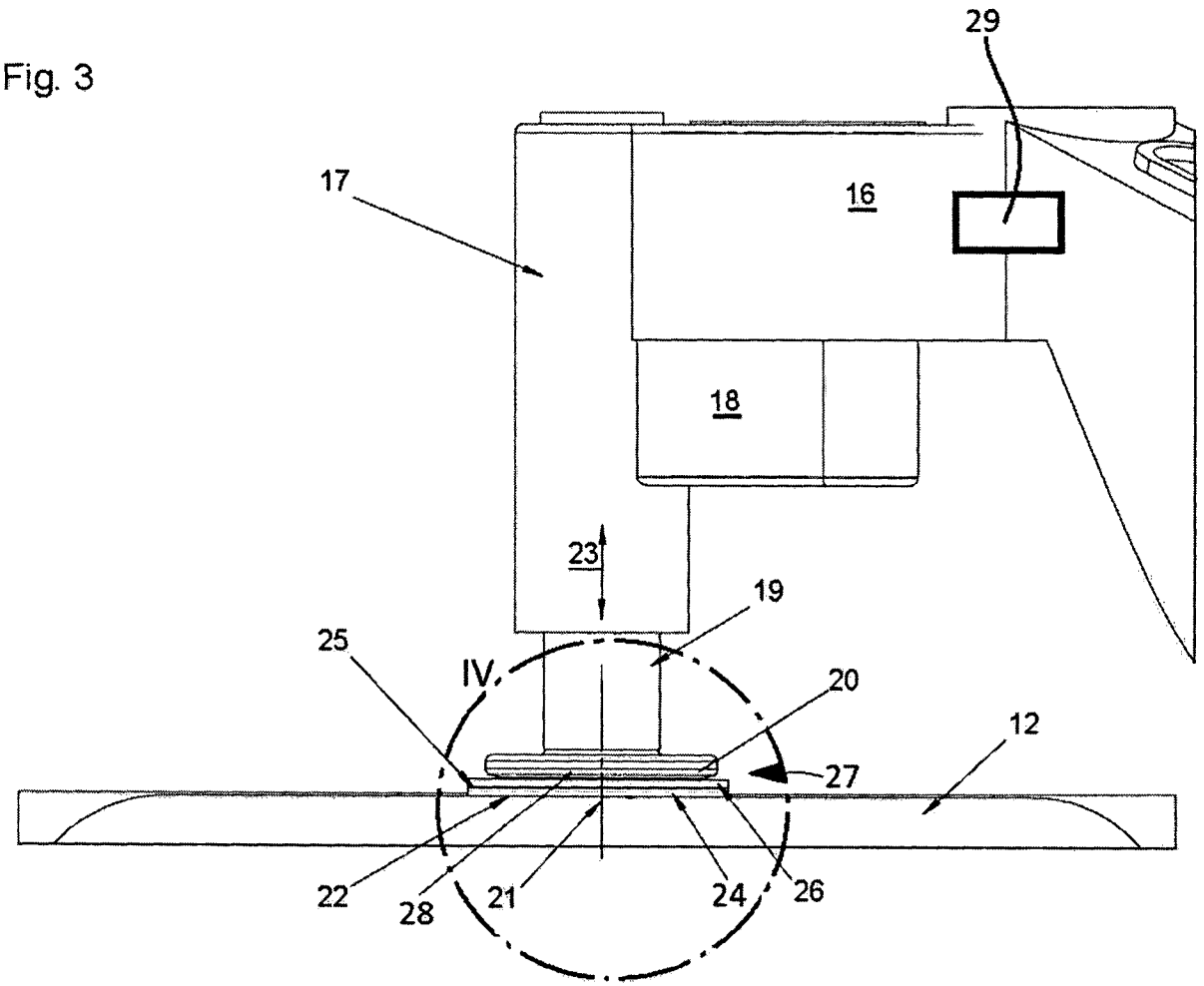
Figure 4:
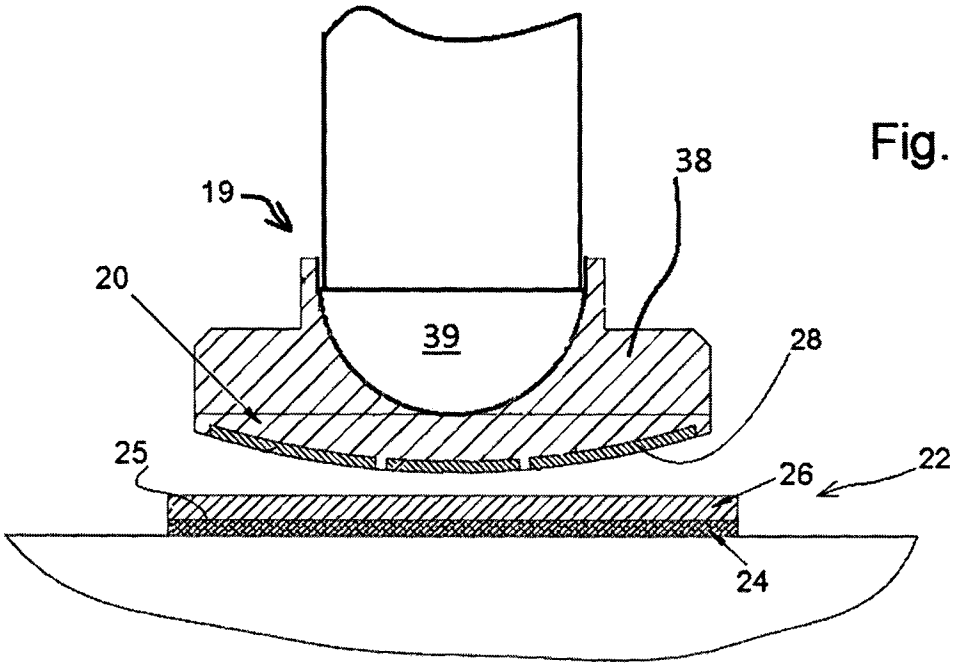
Figure 5:
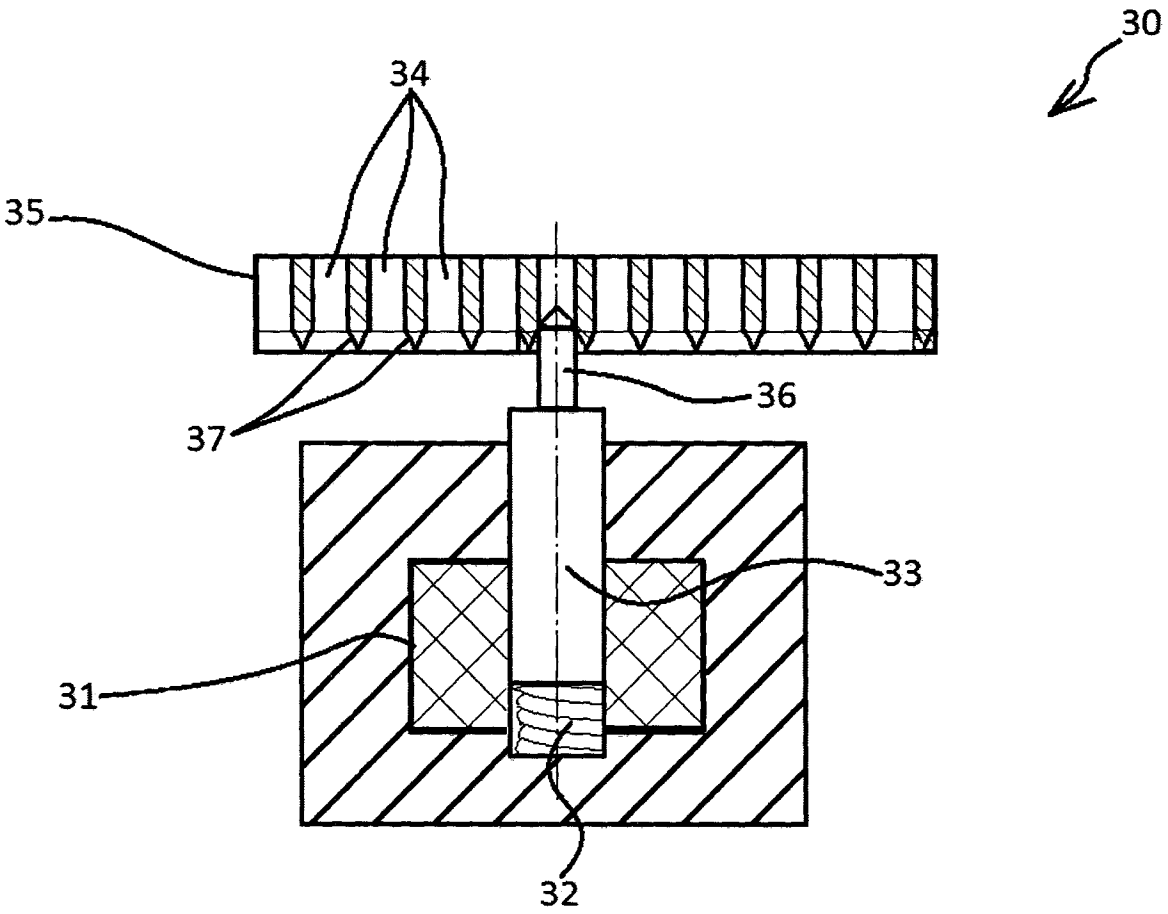
Figure 6:
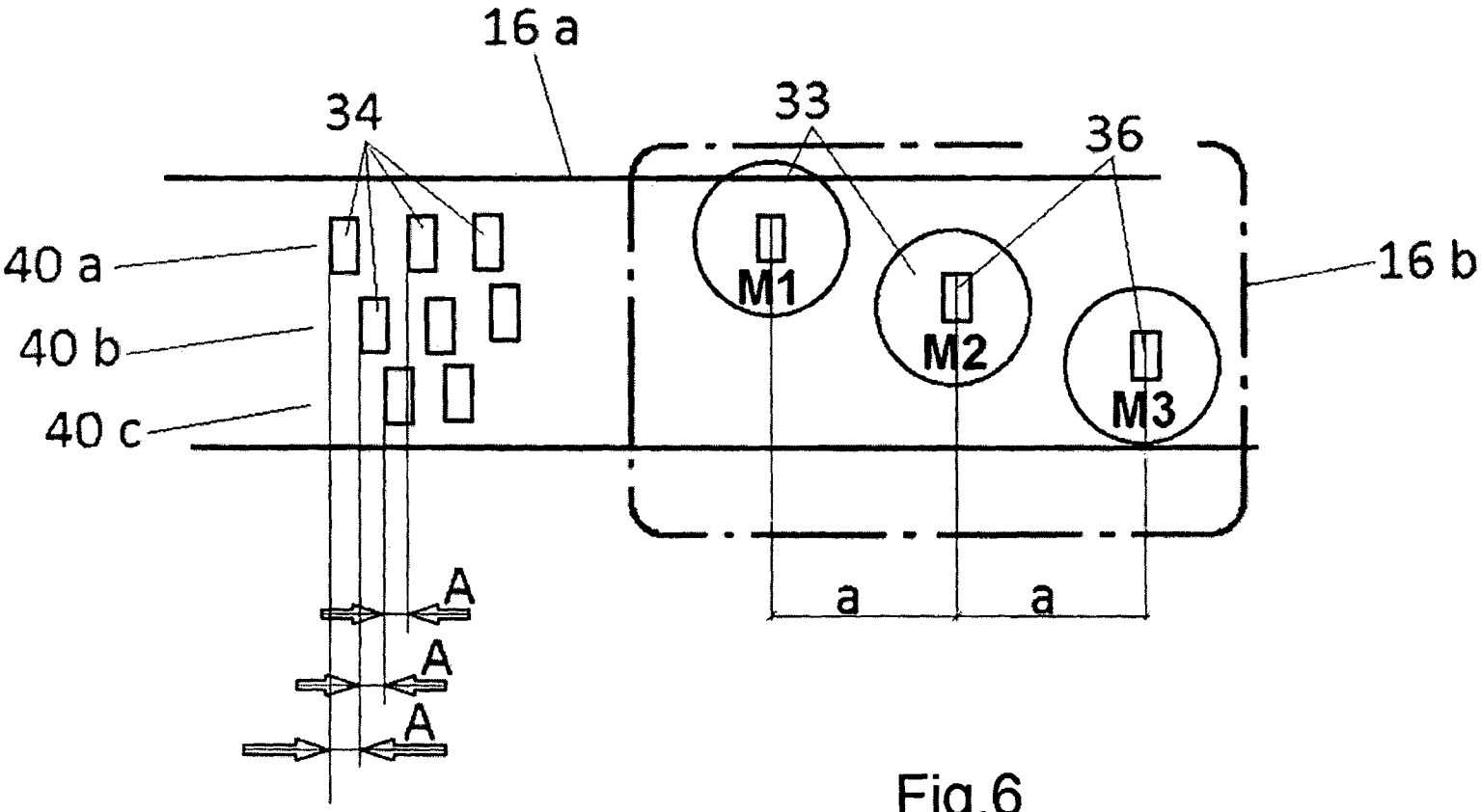

Further features and advantages of the invention emerge from the description below and from the drawing, in which a preferred embodiment of the invention is presented and explained in more detail with the help of an example. The figures show the following:

FIG. 1 an apparatus for cardiopulmonary massaging applied to the thorax of a patient according to the invention in a perspective representation obliquely from above;

FIG. 2 the subject-matter of FIG. 1 in a perspective representation obliquely from below;

FIG. 3 the massaging device of the device according to the invention placed on the patient's thorax in a view;

FIG. 4 a detail IV according to FIG. 3 in a vertical section;

FIG. 5 a schematic cross-sectional representation of a locking mechanism used in the device; and FIG. 6 a modified version of a locking mechanism in a schematic side view.

Shown in FIGS. 1 and 2 in its entirety and labelled with 10 is an apparatus for cardiopulmonary massaging and/or resuscitation of a patient 11 in its position on the patient's ribcage 12. The device 10 has a support board 14, placed under the back 13 of the patient 11, with a massaging device labelled in its entirety with 15, which is disposed in one corner area.

The massaging device 15 has a hinge mechanism 16 attached to the support board 14, said hinge mechanism consisting substantially of a portal support 16 a extending upwards from the support board 14 and, hinged to said portal support's upper, projecting end, a cantilever 16*b*, on the free, outer end of which is provided a plunger unit 17 with a drive 18. With the help of the drive a plunger 19 of the plunger unit 17 can be driven up and down reversingly in a substantially vertical direction 23, for example by means of a drive spindle, which is not shown. The arrangement is such that the portal support 16*a* is swivellable relative to the support board 14 and the cantilever 16*b* is swivellable relative to the portal support 16*a*, each around vertical axes. With the help of a locking mechanism (not represented) in the inside of the housing of the hinge mechanism 16 the swivel movement between the parts of the hinge mechanism can be prevented or enabled in the manner described below.

The portal support is disposed to be repositionable in respect of its height on the support board 14, such that it can be adjusted—preferably steplessly—to various heights and locked in place in the chosen positions.

If one now turns one's attention to FIGS. 3 and 4, one can see that the plunger 19 of the plunger unit 17 has a lower pressure surface 20, which, if the device is used as intended, is placed on the ribcage 12 of the patient 11 in a target contact zone 21—namely normally at the upper end of the lower third of the sternum—and, during operation of the massaging device, performs the cardiopulmonary massage on the patient by the upward- and downward-moving plunger 19 compressing and then releasing the ribcage 12 at a set rate.

In order that the target contact zone 21 or compression point where the pressure surface 20 of the plunger 19 acts does not move during this cardiopulmonary massage, e.g. during the transport of the patient, the plunger 19 is securable in the target contact zone 21 according to the invention. In the preferred embodiment of the invention shown this is achieved with the help of a holding means 22, attachable to the ribcage 12 of the patient 11, in the form of a stick-on holding pad 24, which has on its upper contact surface 25 a loop fabric 26 of a hook-and-loop fastening 27. The mating part for this hook-and-loop fastening 27, namely a web of hooks 28 interacting with the loop fabric 26, is disposed on the pressure surface 20 of the plunger 19. Thus the plunger can be secured on the ribcage 12 of the patient with the holding means 22 after being aligned by way of appropriate swiveling of the hinge mechanism 16 above the target contact zone 21 and lowering of the plunger 19 until in contact with the pressure surface 20, because then the hook-and-loop fastening 27 closes and does not open again until an upward pulling force exceeds the separation force of the hook-and-loop fastener. In order for the doctor or paramedic to be able to align the plunger 19 optimally, even if the holding pad was not positioned 100% initially when stuck onto the patient's chest, the holding means 22 is bigger than the pressure surface 20 of the plunger 19, so sufficient opportunity is created for sideways adjustment.

As mentioned already, the hinge mechanism 16, on which the plunger is disposed, is lockable and unlockable with the help of the locking mechanism, of which the effective part between the portal support 16*a* and the swivellable cantilever 16*b* connected to it is represented schematically at 29 in FIG. 3. The entire locking mechanism has multiple deadlocks 30, wherein preferably at least one such deadlock 30 is provided on each locking-mechanism part 29 for each of the hinged connections or linear guides of the hinge mechanism that are to be locked during a massaging stroke. As FIG. 5 shows, the deadlock 30 (or the deadlocks) is (or are) actuated electromagnetically in the preferred exemplary embodiment, for which purpose it has an electromagnet 31, supplied with a switching current, and also a closing pushrod 33, pretensioned in locking direction by a helical compression spring 32, which pushrod is pressed by the spring 32 against a detent plate 35 provided with a plurality of detent openings 34 lying close to each other. On its front end facing the detent plate 35 the closing pushrod 33 is provided with a detent 36, with which it can engage optionally in any one of the detent openings 34 that define the various detent positions, in order hereby to block mechanically, the mobility of the relevant hinge or of a linear guide. When the electromagnet 31 is supplied with the switching current, which happens between two consecutive massaging strokes during the unloaded state, the closing pushrod 33 is pulled back by the electromagnet 31 against the action of the helical compression spring 32, such that the detent no longer engages in one of the detent openings 34 and thus the locking that existed during the loaded movement phase of the plunger (massaging stroke) is then cancelled in the unloaded or load-free movement phase. Readjustment of the position of the plunger in X-Y direction is then possible. FIG. 5 reveals further, that the detent openings 34 are disposed at discrete distances, as small as possible, from each other, in order to enable locking in correspondingly small steps. The detent openings 34 are also provided with conical guide cones 37 on their side facing the closing pushrod 33, wherein the guide cones 37 of respective neighbouring detent openings 34 affect each other or blend together. This ensures that the detent 36 of the closing pushrod always engages reliably in one of the detent openings 34, when the current to the electromagnet is switched off.

According to the invention, in any case, the locking is cancelled between two massaging strokes, i.e. the part of the movement of the plunger in which the plunger is unloaded and does not compress the ribcage 12 of the patient 11 with force, which leads to the plunger being freely movable in the plane running transversely to the actuating direction 23 (x-Y plane) in this unloaded state between two massaging strokes. In this way any changes in the relative position between the patient and the massaging device are balanced out, i.e. the plunger, which is of course secured to the patient's ribcage, follows the changes of position experienced by the ribcage, e.g. owing to external influences. The plunger is thus guided in the X-Y plane between two massaging strokes from the holding pad stuck on the patient's body and its pressure surface at the start of a subsequent massaging stroke is always precisely above the desired compression point on the patient's thorax.

During the massaging stroke the hinge mechanism of the massaging device is then blocked with the help of the locking mechanism, such that during the massaging stroke the plunger moves only in vertical direction (Z axis), but is locked in the directions perpendicular to this. This ensures that during the compression phase any sideways drift of the plunger is prevented, which could otherwise come about owing to shear forces, which arise regularly with varying degrees of strength on account of an inhomogeneously formed thorax.

In order also to be able to balance out easily any twisting movements between patient and the massaging device, the plunger 19 is mounted in the plunger unit 17 in such a way as to be freely rotatable about the vertical axis. In order to ensure the best possible contact between the pressure surface 20 and the holding means 22 stuck on the ribcage during compression of the thorax, the plunger 19 and its lower plunger head 38, which forms the pressure surface 20, can be attached with a ball joint 39 (FIG. 4), such that the pressure surface can be inclined at will and thereby adapted optimally to the shape of the thorax.

The method for securing the plunger 19 to the ribcage 12 of the patient 11 by means of hook-and-loop fastening that is used in the described, preferred exemplary embodiment also has the result that the plunger is fastened to the adhesive pad in a pull-resistant manner at least until the separation force for opening the hook-and-loop fastener is reached. Because it is also accommodated in the plunger unit of the massaging device in a pull-resistant manner—preferably with slight play (for example 5 to 15 mm)—and thus, after the ending of a compression phase, is actively raised up again by the plunger unit, it exerts a pulling force on the patient's ribcage during this retraction movement, thereby bringing about additionally a decompression (negative compression) and thus a further improvement in the effectiveness of the massage.

The locking mechanism of the device can be controlled actively. Advantageously the locking is activated or released automatically in dependence on the detection of a counter-pressure on the plunger unit. Thus, as soon as the plunger enters the compression phase during a massaging stroke and thereby exerts a massaging force on the ribcage, this leads to a correspondingly large counter-force in Z direction in the massaging device, which ensures forthwith that the mobility of the massaging device is blocked in X and Y direction—in the preferred exemplary embodiment by means of the electromagnetically actuated deadlocks (30).

A particularly advantageous further development of the locking mechanism that can be used in the device of the type according to the invention, but which acquires inventive significance of its own, is sketched in FIG. 6. It comes about, when, to lock the hinge mechanism 16 of the device 10, at least one detent strip 40 is disposed on one of the transmission elements, for example on the portal support 16*a*, wherein the detent strip 40 has a plurality of detent openings 34 disposed at a constant first spacing A from each other. On the other transmission element—here the cantilever 16*b*—there is provided, in this particularly advantageous design, a plurality n (three in the exemplary embodiment shown) of actuatable closure elements 33, each with one detent 36 that can be latched into the detent openings 34. The arrangement is such that the detents of the plurality n (in the exemplary embodiment n=3) closure elements 33 are disposed at a constant second spacing a from each other, which divides the first spacing A between the detent openings 34 in a division ratio T, which satisfies the condition $$T = \frac{a}{A} = \frac{1}{n} + k$$

Here k is an integer constant or zero. The division ratio T can thus correspond to a vernier scale, if nine closure elements 33 are provided. In order to create a particularly space-saving arrangement, as shown, multiple detent strips 40 *a,b,c* can be disposed parallel to each other with their detent openings 34 disposed out of phase with the detent openings 34 of a neighbouring detent strip, wherein at least one closure element 33 is assigned to each detent strip, as represented schematically in FIG. 6.

The invention claimed is:

1. An apparatus for cardiopulmonary massaging and/or resuscitation, with a massaging device having a plunger that is reversibly movable in an actuating direction, can be actuated by a drive and is placeable on the ribcage of a patient in a target contact zone, wherein the plunger is securable to the ribcage of the patient in the target contact zone and is mounted in such a way as to be freely movable in a plane running transversely to the actuating direction at least during an unloaded state between two massaging strokes, wherein the plunger is secured or securable to a holder attachable to the ribcage of the patient, wherein the holder is designed as a holding pad that can be stuck onto the ribcage with an adhesive layer, and wherein the massaging device has at least one lockable and unlockable hinge, repositionable about an axis running parallel to the actuating device, and a lock, actuated by a force sensor and/or path sensor, to prevent transverse mobility of the plunger during a massaging stroke and to lock the at least one hinge.

2. The apparatus according to claim 1, wherein the plunger is lockable in its position relative to the ribcage of the patient in a loaded state during a massaging stroke in the plane running transversely to the actuating direction.

3. The apparatus according to claim 1, further comprising an effective hook-and-loop fastening between the plunger and the holder.

4. The apparatus according to claim 1, wherein the holder has a contact surface that is bigger than the pressure surface formed by the plunger.

5. The apparatus according to claim 1, wherein a support board placeable under the body of the patient and on which the massaging device is disposed.

6. The apparatus according to claim 5, wherein the massaging device is adjustable in respect of its height relative to the support board.

7. The apparatus according to claim 6, wherein the plunger is disposed mounted in such a way as to be freely rotatable on the massaging device.

8. The apparatus according to claim 1, wherein the plunger on the massaging device is disposed, with play such that it is pull-resistant in the actuating direction.

9. The apparatus according to claim 1, wherein the plunger is attached to the massaging device with a ball joint.

10. The apparatus according to claim 1, wherein the lock has at least one deadlock, actuatable by electric motor, which can be latched onto a hinge or a linear guide of the hinge in a plurality of detent positions.

11. The apparatus according to claim 1, wherein the lock has at least one detent strip, disposed on one transmission element of the hinge, with a plurality of detent openings, disposed at a constant first spacing (A) from each other, and a plurality (n) of actuatable closure elements, each with one detent that can be latched into the detent openings, provided on another transmission element of the hinge, wherein the detents of the plurality (n) closure elements are disposed at a constant second spacing (a) from each other, which divides the first spacing (A) between the detent openings in a division ratio (T) of $$T = \frac{a}{A} = \frac{1}{n} + k \ (k \in \mathbb{N}_0).$$

12. The apparatus according to claim 11, wherein the division ratio (T) corresponds to that of a vernier scale.

13. The apparatus according to claim 11, wherein multiple detent strips are disposed parallel to each other with their detent openings disposed out of phase with the detent openings of a neighbouring detent strip, by the division ratio (T), wherein at least one closure element is assigned to each detent strip.

* * * * *